United States Patent [19]

Rathbone

[11] Patent Number: 4,783,208

[45] Date of Patent: Nov. 8, 1988

[54] AIR SEPARATION

[75] Inventor: Thomas Rathbone, London, England

[73] Assignee: The BOC Group plc, Windlesham, England

[21] Appl. No.: 123,445

[22] Filed: Nov. 20, 1987

[30] Foreign Application Priority Data

Nov. 24, 1986 [GB] United Kingdom ..... 8628018
Apr. 3, 1987 [GB] United Kingdom ..... 8707994

[51] Int. Cl.[4] ..... F25J 3/04

[52] U.S. Cl. ..... 62/22; 62/23; 62/38

[58] Field of Search ..... 62/9, 11, 22, 23, 32, 62/38

[56] References Cited

U.S. PATENT DOCUMENTS 3,596,471 8/1971 Streich ..... 62/22
3,729,943 5/1973 Petit ..... 62/22
4,533,375 8/1985 Erickson ..... 62/22
4,617,036 10/1986 Suchdeo et al. ..... 62/11
4,715,873 12/1987 Auvil et al. ..... 62/22

FOREIGN PATENT DOCUMENTS 1315003 4/1973 United Kingdom .
2181828 4/1987 United Kingdom .

*Primary Examiner*—Ronald C. Capossela
*Attorney, Agent, or Firm*—R. Hain Swope; Larry R. Cassett

[57] ABSTRACT

An improvement is provided in a process of separating air in a conventional double rectification column to produce oxygen and argon. In accordance with the invention, refrigeration is transfered to the oxygen-rich liquid conventionally formed in the higher pressure column from oxygen-poor liquid formed by condensing the oxygen-poor vapor formed in the higher pressure column. In addition, a portion of the oxygen-poor liquid is vaporized and either withdrawn as product or expanded in a turbine to provide refrigeration in the process.

18 Claims, 8 Drawing Sheets

AIR SEPARATION

This invention relates to a method and apparatus for separating air.

BACKGROUND OF THE INVENTION

Air separation is well known commercial process and its main products, oxygen, nitrogen and argon, are widely used in industry. Air separation plants capable of producing more than 100 tons per day of product generally employ rectification columns in which the air is separated at cryogenic temperatures. One type of plant produces argon and gaseous oxygen products, and, if desired, gaseous nitrogen and/or liquid nitrogen. In a typical plant of this type, oxygen and argon are separated from air by the steps of:

(a) pasing pressurized air through at least one main heat exchanger so as to reduce its temperature to a level suitable for its separation by cryogenic distillation;

(b) passing air into the higher pressure column of a double rectification column comprising a higher pressure column, a lower pressure column, and a condenser-reboiler which provides reflux for the higher pressure column and reboil for the lower pressure column;

(c) separating the air in the higher pressure column into an oxygen-rich liquid fraction and an oxygen-poor vapor fraction;

(d) condensing the oxygen-poor vapor fraction in the condenser-reboiler, a portion of the condensed vapor being used as reflux in the higher pressure column and collecting the remainder of the condensed vapor;

(e) withdrawing oxygen-poor liquid from the higher pressure column, sub-cooling it and employing the sub-cooled liquid as reflux in the lower pressure column;

(f) withdrawing oxygen-rich liquid from the higher pressure column, sub-cooling it and separating it in the lower pressure column into a nitrogen vapor fraction and a liquid oxygen fraction;

(g) withdrawing a stream relatively rich in argon from the lower pressure column and separating it in a further rectification column into an argon-enriched fraction and an oxygen fraction, the further column having a condenser associated therewith which is refrigerated by the oxygen-rich rich liquid upstream of its introduction into the lower pressure column, withdrawing argon-enriched fluid from the further column; and (h) withdrawing nitrogen vapor and oxygen vapor from the lower pressure column and passing them through a heat exchanger countercurrently to the incoming air.

Typically, the air is pre-purified before introduction into such plants by removing constituents of relatively low volatility such as water vapor and carbon dioxide. Such purification may be accomplished in adsorbers up-stream of the main heat exchanger or by forming the main heat exchanger as a reversing heat exchanger.

The main energy requirement in such a method is that for compressing the incoming air. Typically, the air is compressed to about 6 atmospheres. In the development of air separation plants, one of the key objectives has been to reduce the specific power consumption without adversely effecting the purity of the product gases. In co-pending U.K. Application No. 2 181 828 A, a means for improving the efficiency of air separation is disclosed wherein heat is added at an intermediate level in the lower pressure column by withdrawing liquid from an intermediate level of the lower pressure column, reboiling the liquid in an heat exchanger and returning the resulting vapor to the lower pressure column. The present invention relates to an alternative approach to improving the efficiency of such an air separation method.

SUMMARY OF THE INVENTION

According to the present invention, there is provided an improvement in a conventional method of separating argon and oxygen from air in a double rectification column as described above wherein a portion of the oxygen-poor liquid withdrawn from the low pressure column of the double rectification column is vaporized and either collected as product or expanded with the performance for external work, e.g. in a turbine, to provide refrigeration for the process, refrigeration thereby being transferred from the oxygen-poor liquid to the oxygen-rich liquid.

The invention also provides apparatus for carrying out the subject process of separating air, including means for vaporizing a portion of the oxygen-poor liquid and either means for withdrawing the vaporized liquid as product or turbine means for expanding a portion of the vaporized liquid to generate refrigeration which is conveniently provided to at least one main heat exchanger.

BRIEF DESCRIPTION OF THE DRAWING

The method and plant according to the present invention with now be described by way of example with reference to the accompanying drawings which are not drawn to scale and in which.

Like parts are identified in the respective FIGS. of the drawings by the same reference numerals.

DETAILS DESCRIPTION OF THE INVENTION

Figure 1:
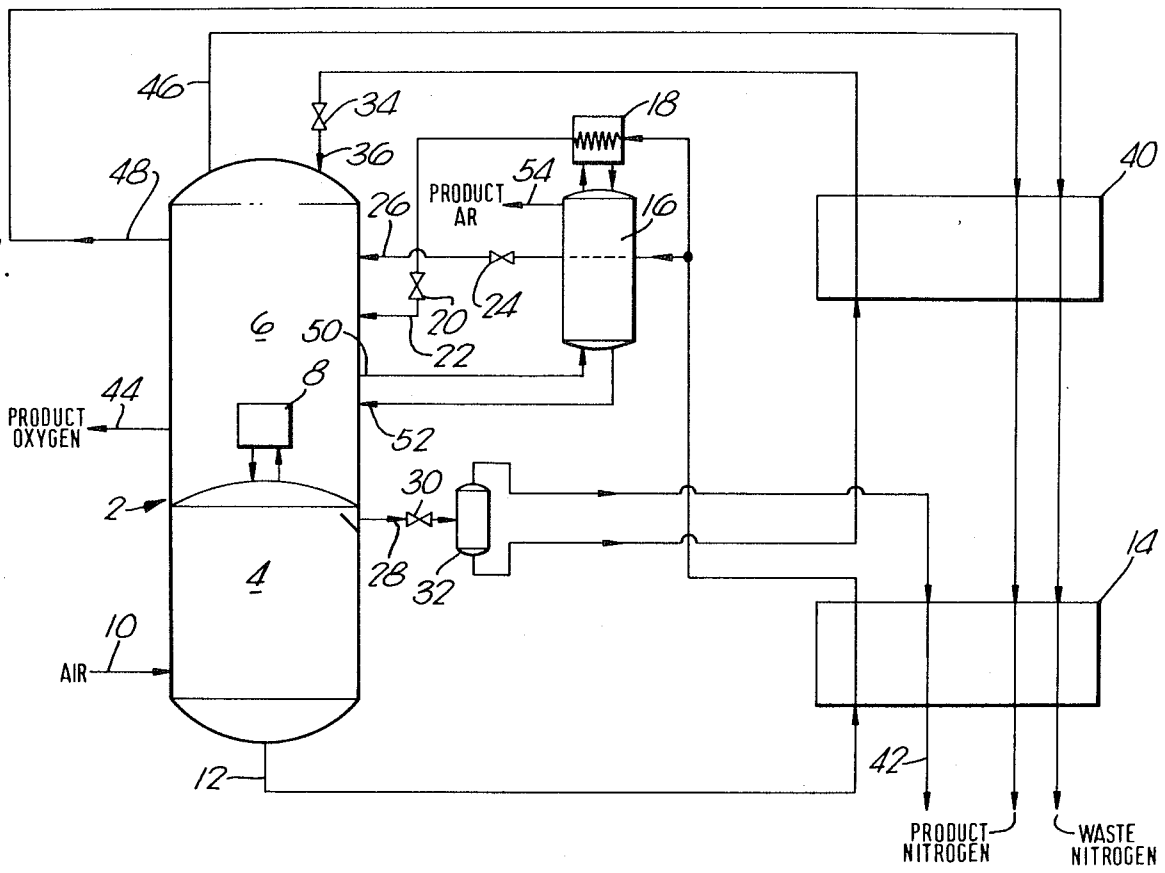
FIG. 1 is a schematic circuit diagram of part of a first plant for separating air in accordance with the invention.

In accordance with this invention, by taking a portion of the oxygen-poor liquid in the high pressure column of a conventional double rectification column as product nitrogen, it is possible to increase the yield of a typical apparatus without an increase in specific power consumption. Moreover, if the nitrogen product is withdrawn at elevated pressure, there is a reduction in the amount of compression required since the nitrogen will typically be produced at a pressure intermediate that of the lower and higher pressure columns of a conventional double rectification column, rather than at that of the lower pressure column. Alternatively, a net reduction in the amount of required compression is made possible by work expansion of the vaporized portion of the oxygen-poor liquid, and preferably, in such embodiments the vaporized liquid is compressed prior to its expansion. If desired, the expansion apparatus or turbine may be coupled to the compressor employed to compress the vaporized liquid.

Where the above-described vaporized portion of the oxygen-poor liquid is taken as product, a portion of the compressed air is preferably taken and raised to a higher pressure, cooled in the main heat exchanger and then expanded to create refrigeration for the main heat exchanger. Such expansion apparatus or turbine may be coupled to the compressor so as to provide drive therefor. Whichever of the above-described means for providing external refrigeration for the main heat exchanger is selected, it may be arranged to provide all the requirements for external refrigeration of that heat exchanger. Alternatively, additional refrigeration means may also be provided.

In the process of the invention, refrigeration is transferred from the oxygen-poor liquid produced by the rectification column to the oxygen-rich liquid produced thereby. The consequence of this is that less oxygen-poor liquid is required to be introduced into the top of the lower pressure column since the oxygen-rich liquid provides more refrigeration to the lower pressure column than in a conventional process, thus allowing a portion of the oxygen-poor liquid to be taken as product nitrogen or used to generate refrigeration for the main heat exchanger.

In other preferred embodiments of the invention, a stream of oxygen-poor liquid withdrawn from the rectification column is heat exchanged with a vapor stream that is withdrawn from a level of the lower pressure column intermediate its top and bottom, the vapor stream thereby being at least partially condensed, and the condensate returned to the lower pressure column. The vapor stream is preferably withdrawn from the same level of the lower pressure column as a stream relatively rich in argon. The oxygen-poor liquid, typically vapor, that passes out of heat exchange relationship with the intermediate condenser may be withdrawn as product or expanded, e.g. in a turbine, to generate refrigeration. Heat exchange between the oxygen-poor liquid and the intermediate vapor stream reduces the requirements for oxygen-poor liquid to be used as reflux at the top of the lower pressure column, thus enabling a part of the oxygen-poor liquid to be taken as product or used to generate refrigeration for the main heat exchanger.

The transfer of refrigeration from the oxygen-poor to the oxygen-rich liquid is preferably carried out by flashing the oxygen-poor liquid into a separator in which the resultant fluid is separated into liquid and vapor phases, withdrawing vapor from the separator and heat exchanging it against the oxygen-rich liquid being subcooled. This heat exchange enables the oxygen-rich liquid to be sub-cooled to a lower temperature than in a conventional plant and, hence, less flash gas is produced on introducing the oxygen-rich liquid in to the lower pressure column. The vapor stream is taken as product or is expaned to generate refrigeration for the main heat exchanger. The liquid from the phase separator is typically introduced into the lower pressure column in a conventional manner. If desired, the condenser associated with the further column may be located in the phase separator. In embodiments of the invention in which the oxygen-poor liquid is flashed into a phase separator, preferably only a portion of the oxygen-rich liquid is passed through the condenser associated with the further rectification column, and the remainder is introduced into the lower pressure column without passing through the condenser associated with the further rectification column.

An alternative or additional method of transferring refrigeration from the oxygen-poor liquid to the oxygen-rich liquid is to employ a portion thereof to provide refrigeration for the condenser associated with the further rectification column. Typically, this does not effect a reduction in temperature of the oxygen-rich liquid but means that a greater proportion of the oxygen-rich liquid leaves the condenser associated with the further rectification column in the liquid state.

If desired, the portion of the oxygen-poor liquid that is used to provide refrigeration to the condenser associated with the further rectification column may be mixed in an auxiliary liquid-vapor contact column, in which the condenser is located, with a stream of liquid oxygen withdrawn from the lower pressure column. A stream of nitrogen, or a gas mixture comprising oxygen and nitrogen may be withdrawn from the auxiliary column and taken as product or expanded to provide refrigeration to, for example, the main heat exchanger.

If desired, the oxygen-poor liquid that is employed to provide refrigeration for the condenser associated with the further rectification column may be taken from the phase separator into which the oxygen-poor liquid is flashed. The stream withdrawn from the auxiliary column may be mixed with or kept separate from the vapor withdrawn from the separator.

Turning to the drawings and referring to FIG. 1, an air separation on plant includes a double column 2 comprising a higher pressure column 4 and a lower pressure column 6. The columns 4 and 6 are linked by a condenser-reboiler 8 which provides reflux for the column 4 and reboil for the column 6.

The higher pressure column 4 typically operates at a pressure on the order of 6 atmospheres absolute. It has an inlet 10 for air that has been purified by removal of water vapor and carbon dioxide and then cooled in a main heat exchanger to a temperature suitable for its subsequent separation in the column 2. As is conventional, the air admitted to the column 4 is separated into an oxygen-rich fraction that collects at the bottom of the column 4, and an oxygen-poor fraction that collects at the top of the column 4. Typically, the oxygen-poor fraction contains only a small proportion of oxygen and is thus substantially pure nitrogen. Oxygen-rich liguid is withdrawn from the bottom of the column 4 through an outlet 12 and is sub-cooled in a heat exchanger 14. The resulting sub-cooled liquid is divided into two portions. A first portion is employed to provide refrigeraton for a condenser 18 associated with a side or argon column 16 that is employed to produce a crude argon product from a fluid stream withdrawn from the lower pressure column 6. Oxygen-rich fluid leaving the condenser 18 is then flashed through an expansion valve 20 into the lower pressure column 6 through an inlet 22. The remaining portion of sub-cooled, oxygen-rich liquid is flashed through valve 24 into the column 6 via an inlet 26.

Oxygen-poor liquid is withdrawn from the top of the column 4 through an outlet 28 and is flashed through an expansion valve 30 into a phase separator 32 which separates under gravity the residual liquid from the flash gas. The oxygen-poor liquid from the separator 32 is sub-cooled by passage through heat exchanger 40 and the resulting sub-cooled oxygen-poor liquid is flashed through valve 34 into the top of the column 6 via an inlet 36.

The oxygen-rich liquid entering the column 6 is separated into oxygen and nitrogen fractions. Liquid oxygen is reboiled in the condenser-reboiler 8 and liquid nitrogen reflux is provided by the oxygen-poor liquid entering the top of the column 6 through the inlet 36. Typically, the column 6 operates at a pressure in the order of one and half atmospheres absolute. A gaseous oxygen product is withdrawn from the column 6 through an outlet 44 and a gaseous nitrogen product is withdrawn from the top of the column 6 through an outlet 46. In addition, an impure nitrogen stream is withdrawn from the column 6 through the outlet 48. The streams withdrawn from the column 6 through the outlets 46 and 48 are respectively passed through the heat exchangers 40 and 14, in that sequence, countercurrently to the liquid being sub-cooled. Heat exchange with these streams effects the sub-cooling of the oxygen-rich liquid and the oxygen-poor liquid.

As those skilled in the art will appreciate, a local maximum argon concentration tends to occur at an intermediate level of the low pressure column 6. An outlet 50 is located at such intermediate level and a fluid stream comprising oxygen and argon is withdrawn through the out-let 50 and is passed into the bottom of the rectification column 16, in which it is separated into oxygen and argon. Liquid-oxygen is returned through inlet 52 to the column 6 and a crude product liquid argon stream is withdrawn through outlet 54 from the top of column 16 and, if desired, further purified.

Referring to the separator 32, a stream of vapor is withdrawn from the top thereof and is passed through the heat exchanger 14 countercurrently to the oxygen-rich liquid. This vapor stream produces additional sub-cooling for the oxygen-rich liquid. It thus provides a means for transferring refrigeration from the oxygen-poor liquid to the oxygen-rich liquid. Moreover, the expansion valve 30 and separator 32 are preferably arranged so that the pressure at which the vapor is provided is between the operating pressures of the columns 4 and 6 and may, for example, be about 2.8 atmospheres. The pressure available in this vapor stream may be utilized by withdrawing the stream 42 as an additional nitrogen product, with additional compression of the product if desired, or by employing it as a working fluid in a refrigeration cycle used to provide refrigeration for the main heat exchanger or to perform some other heat exchange duty. For example, if the plant shown in FIG. 1 is associated with a nitrogen liquefier (not shown), the stream 42 may be used as working fluid in a refrigeration cycle employed therein.

The vapor stream withdrawn from the separator 32 enables the oxygen-rich liquid to be sub-cooled in the heat exchanger to a lower temperature than is conventional in such systems. Accordingly, appreciably less flash gas is produced by passage of the liquid through the expansion valves 20 and 24. The reduction in the amount of flash gas produced is believed to be beneficial to the column 6 and, in effect, enables a proportion of the oxygen-poor liquid to be diverted from its normal duties of providing reflux to the top of the column 6 and to be taken either as product or utilized as a working fluid in a refrigerant cycle. Generally, it is preferred that the amount of refrigeration provided to the column 6 by the oxygen-rich liquid and the oxygen-poor liquid be substantially the same as in a conventional process. Accordingly, it will be appreciated that a greater proportion of this refrigeration will be provided by the introduction of the oxygen-rich liquid into the column than is customary. Since the oxygen-rich liquid is introduced into the column at higher temperatures than the oxygen-poor liquid, more refrigeration is provided at a higher temperature, thereby enabling a more efficient separation to take place in the column 6. From such thermodynamic considerations, it will be appreciated that the increased efficiency in the operation of the column 6 enables additional product to be withdrawn from the oxygen-poor liquid.

Figure 2:
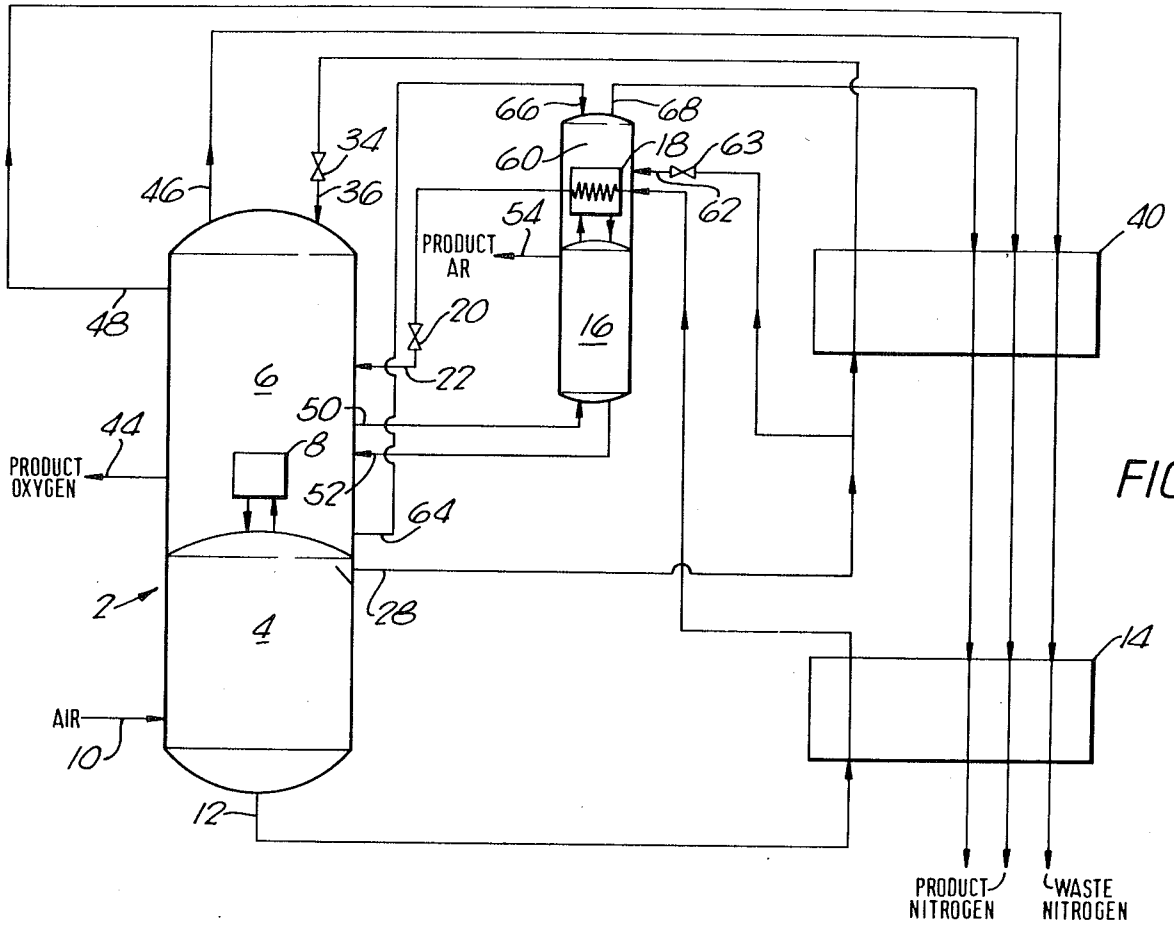
FIG. 2 is a schematic circuit diagram of part of the second plant for performing the method according to the invention.

The plant shown in FIG. 2 has many similarities to that shown in FIG. 1 and the portions thereto having a similar function to corresponding portions in FIG. 1 will not be again described. One main difference between them is that there is no flash separation of the oxygen-poor liquid withdrawn through the outlet 28 of the column 4 in FIG. 2. However, as in the plant shown in FIG. 1, not all of the liquid withdrawn through the outlet 28 flows through the expansion valve 34. Some of the withdrawn liquid is taken from the stream flowing to the column 6 at a location upstream of the heat exchanger 40. This part of the sub-cooled liquid is flashed through valve 63 and the resulting fluid is introduced through an inlet 62 into a bottom region of an auxiliary liquid-vapor contact column 60 whose function is to mix the fluid with a liquid oxygen stream withdrawn through outlet 64 from the bottom of the lower pressure column 6. This liquid oxygen is introduced into the column 60 at the top thereof through inlet 66. The mixing of the two streams in the column 60 is effective to provide additional refrigeration for the condenser 18 thereby allowing for an enhanced rate of argon condensation in the condenser 18 and hence, an enhanced rate of production of liquid argon. Typically, the nitrogen entering the column 60 through the inlet 62 enters a volume of liquid nitrogen in which the condenser 18 is immersed or partially immersed. The condenser 18 thus functions as a reboiler for the column 60. A stream of gas is withdrawn from the column 60 through an outlet 68. This stream typically comprises a mixture of the nitrogen introduced therein through the inlet 62 and the oxygen introduced into the column 60 through the inlet 66. The stream withdrawn from the column 60 through the outlet 68 passes through the heat exchangers 40 and 14 in sequence counter-currently to the liquid being sub-cooled therein. The column 60 preferably operates at a pressure intermediate that of the higher pressure column 4 and the lower pressure column 6. For example, the stream withdrawn from the outlet 68 may have a pressure of 2.8 atmospheres and may be utilized, if relatively pure, as product nitrogen, or may be used as a working fluid in a refrigeration cycle.

Similarily to the plant shown in FIG. 1, the stream of oxygen-poor liquid introduced into the column 60 through the inlet 62 is effective to provide refrigeration to the sub-cooled, oxygen-rich liquid. In this instance, the transfer of refrigeration takes place in the condenser 18 of the argon side column 16. Unlike the plant shown in FIG. 1, however, this transfer of refrigeration does not provide any substantial degree of additional sub-cooling. Rather, a greater proportion of the oxygen-rich fluid exiting the condenser 18 is in the liquid state. This has the effect of rendering the operation of the column 6 more efficient and thereby allows removal of the stream 68 from the column 60, which stream is, in effect, withdrawn from the oxygen-poor liquid without loss of efficiency.

Figure 3:
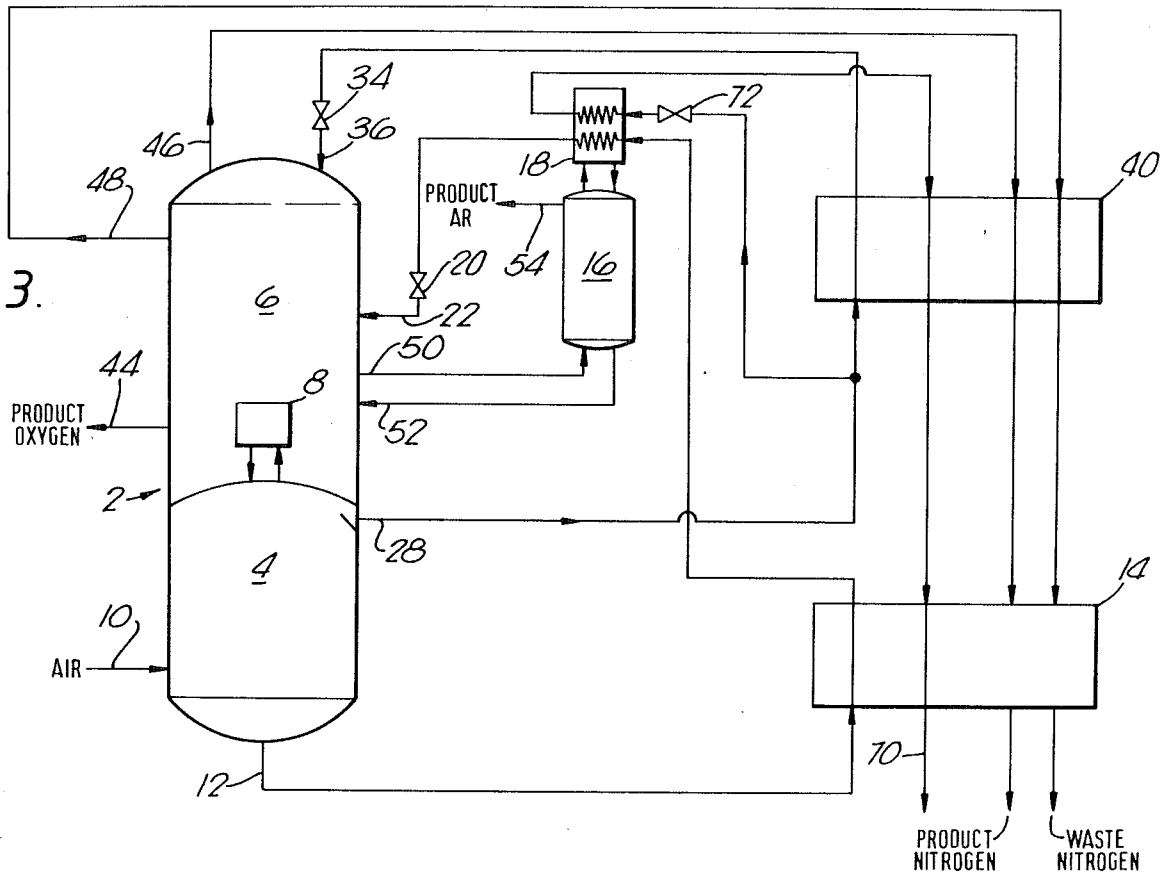
FIG. 3 is a schematic circuit diagram of part of the third plant for performing the method according to the invention.

Referring now to FIG. 3, a further alternative plant is illustrated. In this plant, there is also transfer of refrigeration from the oxygen-poor liquid to the oxygen-rich liquid in the condenser 18. However, in this example, an auxiliary column is not utilized. Instead, the portion of the oxygen-rich liquid that is withdrawn from the sub-cooled liquid at a region upstream of the heat exchanger 40 is passed through the condenser 18 without undergoing any mixing with liquid oxygen or other oxygen stream taken from the column. After passage through the condenser 18, the oxygen-poor liquid is returned through the heat exchangers 40 and 14 in sequence, flowing counter-currently to the liquid being sub-cooled. The liquid nitrogen entering the condenser 18 is preferably expanded through an expansion valve 72 upstream of the condenser 18 such that it enters the condenser 18 at a pressure that is intermediate the average pressures of the columns 4 and 6, for example, a pressure of about 2.8 atmospheres absolute. The resulting nitrogen fluid leaving the condenser 18 after its passage through the heat exchangers 40, 38 and 14 may be taken as a stream 70 of nitrogen product or alternatively may be used as a working fluid in a refrigeration cycle. The advantages to be obtained from the plant shown in FIG. 3 are analogous to those to be obtained from the use of the plant shown in FIG. 2, save that there is an additional advantage since it is not necessary to divert liquid oxygen from the lower pressure column 6 through the outlet 64 to the auxiliary column 60.

Figure 4:
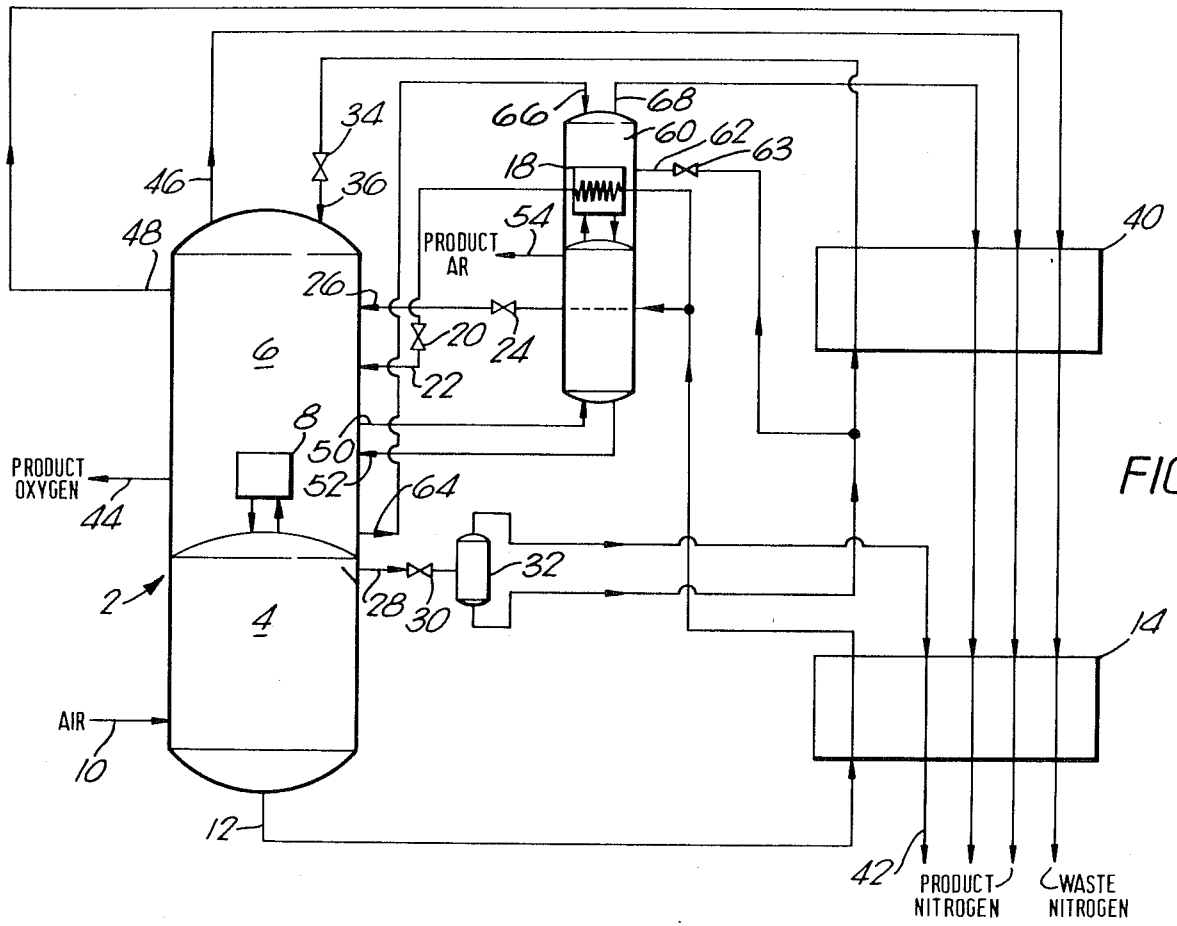
FIG. 4 is a schematic circuit diagram of part of the fourth plant for performing the method according to the invention.

The plant shown in FIG. 4 is a particularly preferred embodiment since it enables refrigeration to be effectively transferred from the oxygen-poor liquid to the oxygen-rich liquid at two locations namely in the sub-cooling heat exchanger 14 and in the condenser 18. The plant shown in FIG. 4 thus combines the phase separator 32 and associated expansion valve 30 of FIG. 1 with the column 60 of FIG. 2. Thus, in the plant shown in FIG. 4, it is the liquid separated in the separator 32 which is subsequently divided at a location upstream of heat exchanger 40 to provide one portion of sub-cooled liquid that is introduced into the column 16 through the valve 34 and inlet 36 as reflux and another portion of sub-cooled liquid that is introduced through the inlet 62 into the column 60. The advantages provided are therefore the same as the advantages provided by the plants shown in FIGS. 1 and 2. Typically, though not necessarily, the phase separator 32 and the auxiliary column 60 operate at the same pressure. The vapor stream from the phase separator 32 may be kept separate from the stream withdrawn from the column 60 through the outlet 68 or may be mixed with such stream. The steam of sub-cooled liquid that passes through the valve 24 may typically have a temperature of 89K upstream of the valve 24 such that the fluid entering the column 6 through the inlet 26 contains about 5.7% by volume of flash gas.

Figure 5:
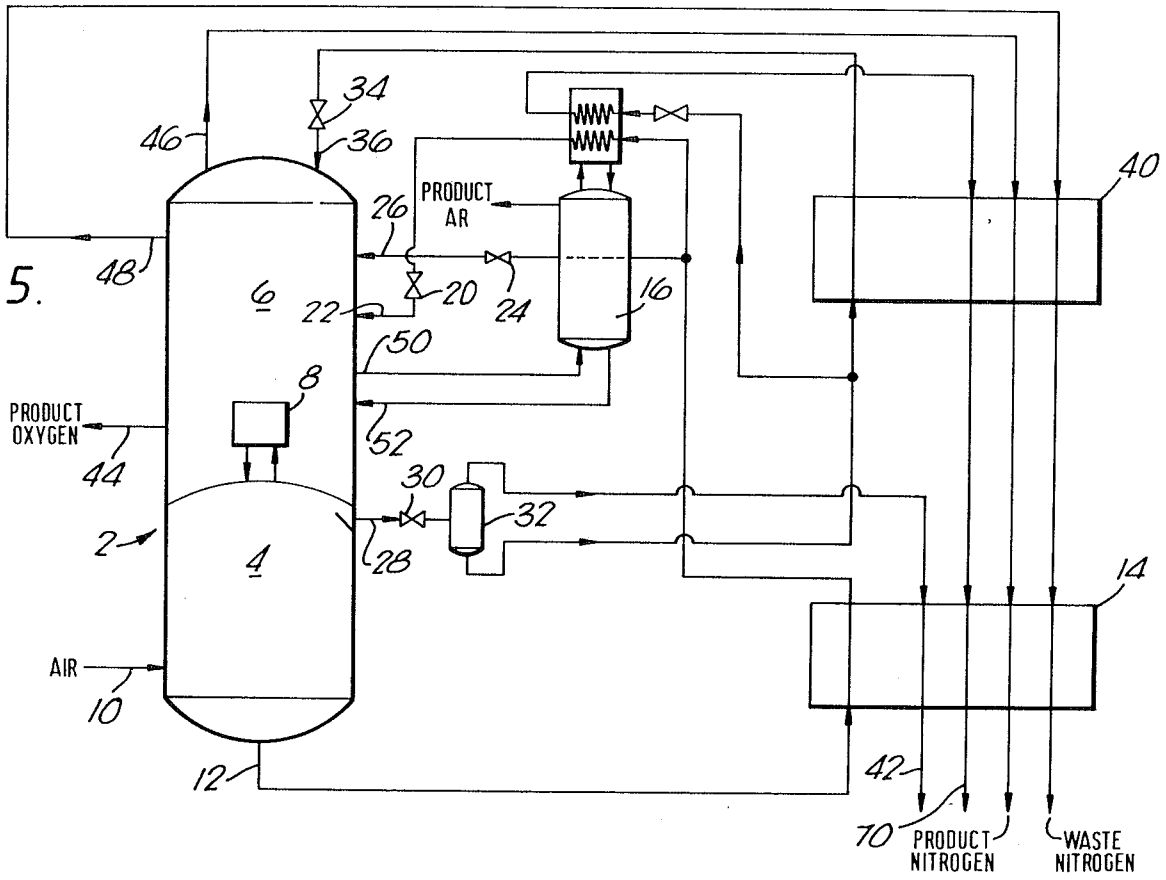
FIG. 5 is a schematic circuit diagram of part of a fifth plant for performing the method according to the invention.

Referring now to FIG. 5, just as the plant shown in FIG. 4, in effect, combines the phase separator 32 (with its associated expansion valve 30) with the auxilliary liquid-vapor contact column 60 of FIG. 2, so the plant in FIG. 5 combines the phase-separator 32 (and its associated expansion valve 30) with the oxygen-poor fluid passing through the condenser 18 that is illustrated in FIG. 3. As in the plant shown in FIG. 4, it is the sub-cooled liquid taken from the separator 32 that is divided into two parts intermediate the heat exchangers 14 and 40. Typically, the oxygen-poor stream exiting the condenser 18 is at substantially the same pressure as that of the vapor stream exiting the phase separator 32, though, if desired, these two fluids may be at different pressures. Streams 42 and 70 may be kept separate or may be mixed.

Figure 6:
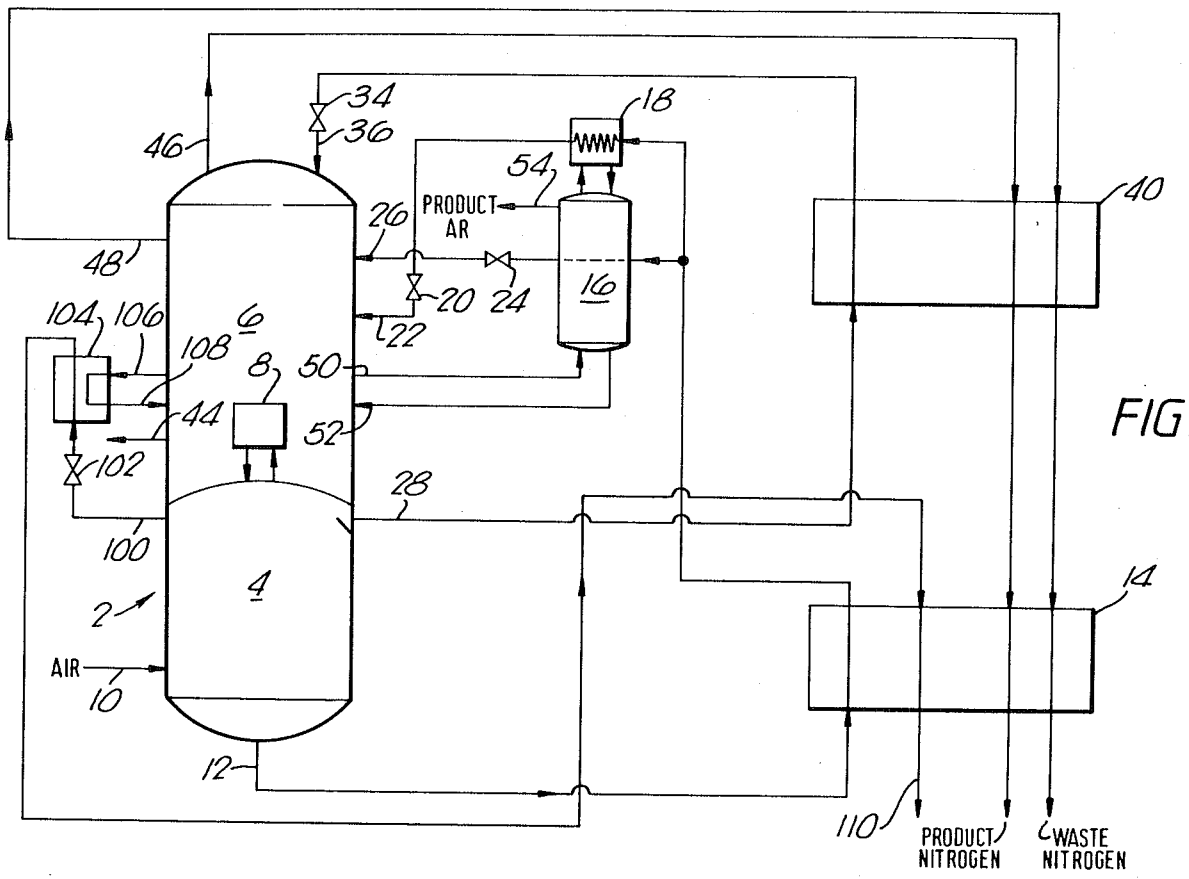
FIG. 6 is a schematic circuit diagram of part of a sixth plant for performing the method according to the invention.

Referring now to FIG. 6, there is illustrated a plant in which there is transfer of refrigeration from the oxygen-poor liquid by passing it in heat exchange with a vapor stream withdrawn from an intermediate level of the low pressure column 6, this vapor stream being condensed and the resulting liquid returned to the low pressure column. It is possible to take vaporized, oxygen-poor liquid resulting from the heat exchange with the stream withdrawn from the column 6 and employ the vaporized liquid either as product or as working fluid in a refrigerant cycle to refrigerate the heat exchanger. Accordingly, a portion of the oxygen-poor liquid collecting at the top of the column 4 is withdrawn through an outlet 100, and is passed through a throttling or expansion valve 102 so as to reduce the pressure to which it is subjected to 4.7 atmospheres absolute. The resulting fluid is introduced into a heat exchanger 104 and is vaporized therein by heat exchange with a stream of vapor withdrawn from the column 6 through an outlet 106 which is at the same level as the outlet 50. The stream of vapor is condensed in the heat exchanger 106, and the condensate is returned to the low pressure column 6 through an inlet 108. The vaporized oxygen-poor liquid leaving the heat exchanger 104 is passed back through the heat exchanger 14 countercurrently to the oxygen-rich liquid withdrawn from the column through the outlet 12 and thus provides refrigeration to this stream. After leaving the heat exchanger 14, the oxygen-poor liquid flows out of the illustrated plant as stream 110 which may be used to provide refrigeration for the main heat exchanger, or may be taken as product.

Figure 7:
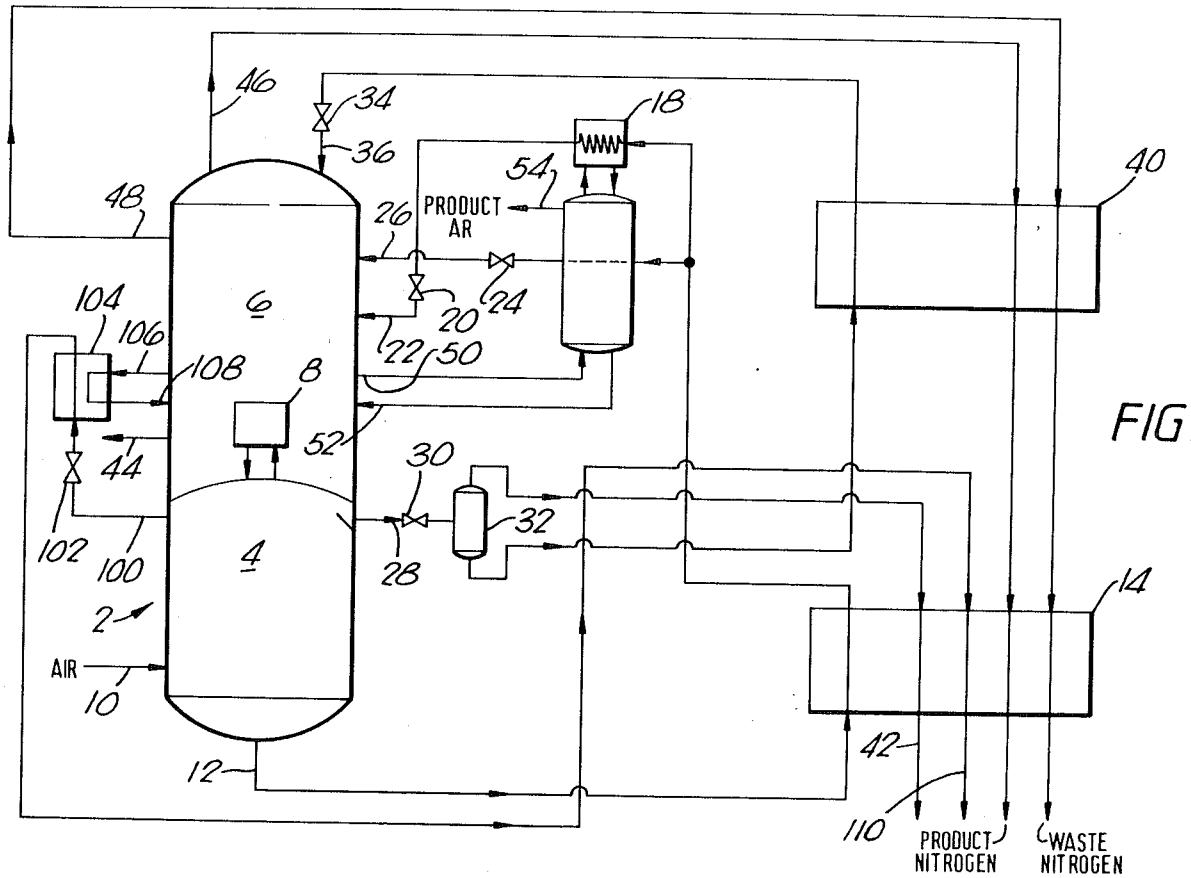
FIG. 7 is a schematic circuit diagram of part of a seventh plant for performing the method according to the invention.
Figure 8:
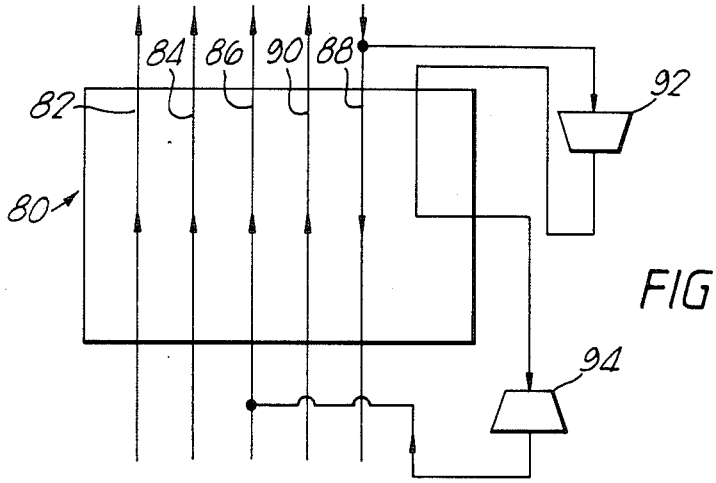
FIG. 8 is a schematic circuit diagram of the main heat exchanger refrigeration plant that can be used in conjunction with any one of the plants shown in FIGS. 1 to 7.

The oxygen-poor liquid withdrawn through the outlet 28 may be employed as reflux in the low pressure column 6, as shown in FIG. 6, or may be passed through throttling valve 30, and into phase separator 32. The resulting liquid is used as reflux and the resulting vapor passed through the heat exchanger 14 countercurrently to the oxygen-rich liquid to form stream 42 which may be taken as product or as working fluid in a refrigeration cycle. Referring now to FIG. 8, there is illustrated a main heat exchange unit 80 for use in association with any one of the plants shown in FIGS. 1 to 7. There are a number of passages through the heat exchanger 80. There is a passage 82 for a low pressure gaseous oxygen stream which is the one withdrawn from the outlet 44 of any one of the low pressure columns shown in FIGS. 1 to 7, a passage 84 for a low pressure product nitrogen gas stream which is taken from the product nitrogen stream exiting the heat exchanger 14 in any one of the plants shown in FIGS. 1 to 5, and a passage 86 for a low pressure waste nitrogen stream which is taken from the waste nitrogen stream exiting the heat exchanger 14 in any one of the plants shown in FIGS. 1 to 7. In addition, there is a passage 88 for air from which low volatility impurities such as water and carbon dioxide have been removed. The air typically enters the heat exchanger unit 80 at a pressure on the order of 6 atmospheres absolute. There is also a passage 90 for a product nitrogen stream at a pressure greater than the average operating pressure of the low pressure column 6, but lower than that of the high pressure column 4. The gaseous streams flow through the passages 82, 84, 86 and 90 countercurrently to the incoming air flowing through the passage 88. If the plant shown in FIG. 8 is to be used in conjunction with that shown in FIG. 1, it is the stream 42 shown in FIG. 1 that passes through the passage 90. If the plant shown in FIG. 8 is used in conjunction with the plant shown in FIG. 2, it is the stream withdrawn from the outlet 68 of the column 60 that passes through the passage 90. If the plant shown in FIG. 8 is to be used in conjunction with the plant shown in FIG. 3, it is the stream 70 that flows through the passage 90. If the plant shown in FIG. 8 is to be used in conjunction with the plant shown in FIG. 4, the stream flowing through the passage 90 may be a mixture of the stream 42 with the gas withdrawn from the outlet 68 of the column 60. If the plant shown in FIG. 8 is to be used in conjunction with the plant shown in FIG. 5, the stream flowing through the passage 90 may be a mixture of the streams 42 and 70. If the plant shown in FIG. 8 is to be used in conjunction with the plant shown in FIG. 6, the stream flowing through the passage 90 may be the stream 110, and if the plant shown in FIG. 8 is to be used in conjunction with the plant shown in FIG. 7, the stream flowing through the passage 90 may be a mixture of the streams 42 and 110.

In order to provide refrigeration for the heat exchanger 80, a portion of the pressurized air is withdrawn upstream of the warm end of the heat exchanger 80 and is further compressed in a booster-compressor 92. This air then flows through the heat exchanger 80 co-currently with the rest of the air, is withdrawn from the heat exchanger 80 at an intermediate location thereof, is expanded with the recovery of energy in an expansion turbine 94, which is desirably coupled to the compressor 92, and is then united with the waste nitrogen flowing through the passage 86 immediately upstream of its entry into the heat exchanger 80. The outlet pressure of the booster-compressor 92 and the outlet pressure of the turbine 94 may be selected such that the refrigeration provided by the turbine 94 is effective to meet all the requirements for refrigeration of the heat exchanger 80. Alternatively, for example, part of the waste nitrogen stream may be employed in a similar refrigeration circuit including a booster-compressor and a turbine to provide the rest of the refrigeration requirements of the heat exchanger 80.

Figure 9:
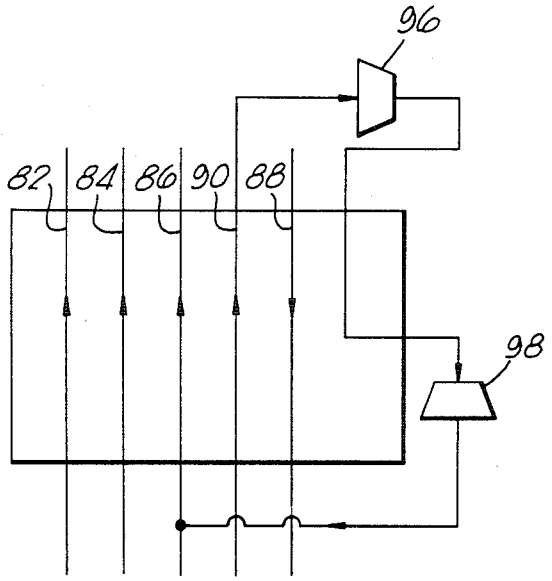
FIG. 9 is a circuit diagram illustrating an alternative refrigeration plant to that shown in FIG. 8.

FIG. 9 shows a heat exchanger similar to the one illustrated in FIG. 8. In this example, however, it is the gas passing through the passage 90 that is first compressed and then expanded to provide refrigeration for the heat exchanger 80, and all the incoming air 88 is passed through the heat exchanger 80. Accordingly, the nitrogen stream leaving the passage 90 at the cold end of the heat exchanger 80 is compressed in a booster-compressor 96 and is then returned through the heat exchanger 80 co-currently with the air flowing through the passage 88 and is then withdrawn from the heat exchanger 80 at an intermediate region thereof and is expanded in an expansion turbine 98 for the performance of external work. As is the case with the arrangement shown in FIG. 8, the cold gas exiting the expansion turbine 98 is united with the waste nitrogen stream immediately upstream of the warm end of the heat exchanger 80. The expansion turbine 98 is preferably coupled to the booster-compressor 96.

I claim:

1. In a method of separating argon and oxygen from air comprising:

(a) passing air under pressure at low temperature into a double rectification column comprising a higher pressure column, a lower pressure column and a condenser-reboiler;

(b) forming in said higher pressure column an oxygen-rich liquid fraction and an oxygen-poor vapor fraction;

(c) condensing the oxygen-poor fraction in the condenser-reboiler a portion of the condensed vapor being utilized as reflux for the higher pressure column and the remainder being withdrawn therefrom;

(d) sub-cooling said withdrawn portion of the condensed oxygen-poor fraction and utilizing at least a portion of the resulting liquid as reflux in said lower pressure column;

(e) separating the oxygen-rich liquid fraction in the lower pressure column to form a nitrogen vapor fraction and an oxygen liquid fraction;

(f) withdrawing an argon-enriched stream from an intermediate level of the lower pressure column and separating it in a further column having thereon a condenser to form an argon-rich fraction and an oxygen fraction, said condenser being refrigerated by the oxygen-rich liquid prior to introduction thereof into the lower pressure column; and (g) withdrawing nitrogen vapor and oxygen vapor from the lower pressure column and passing them through a heat exchanger countercurrently to the incoming air, improvement wherein refrigeration is transferred from the oxygen-poor liquid formed in step (d) to the oxygen-rich liquid formed in step (b) and a portion of said oxygen-poor liquid is vaporized and expanded in a turbine to provide refrigeration for the process.

2. A method in accordance with claim 1, wherein said refrigeration is provided to said heat exchanger.

3. A method in accordance with claim 1, wherein said vaporized portion of oxygen-poor liquid is compressed prior to being expanded.

4. A method in accordance with claim 1, wherein a portion of the incoming air is further compressed, cooled in the heat exchanger, expanded in a turbine and utilized to provide refrigeration for the heat exchanger.

5. A method in accordance with claim 1, wherein refrigeration is transferred by flashing the oxygen-poor liquid into a separator thereby forming liquid and vapor phases, the vapor phase being passed in heat exchange with the oxygen-rich liquid being sub-cooled and subsequently withdrawn as product or expanded in a turbine to provide refrigeration and the liquid phase is introduced into the lower pressure column as oxygen-poor liquid.

6. A method in accordance with claim 5, wherein the condenser associated with said further column is located in said separator.

7. A method in accordance with claim 1, wherein a portion of the sub-cooled oxygen-poor liquid formed in step (d) is used to provide refrigeration in the condenser associated with said further column.

8. A method in accordance with claim 7, wherein said oxygen-poor liquid is mixed with a stream of liquid oxygen withdrawn from the lower pressure column in an auxiliary liquid-vapor contact column which contains said condenser, there being formed a stream of nitrogen or a mixture of nitrogen and oxygen which is withdrawn as product or expanded in a turbine to provide refrigeration.

9. A method in accordance with claim 7, wherein said oxygen-poor liquid is mixed with a stream of liquid withdrawn from the lower pressure column in an auxiliary liquid-vapor contact column which contains said condenser, there being formed a stream of nitrogen or a mixture of nitrogen and oxygen which is withdrawn as product.

10. A method in accordance with claim 1, wherein a portion of the oxygen-poor liquid is passed in heat exchange with a vapor stream withdrawn from an intermediate level of the lower pressure column, said vapor stream being at least partially condensed thereby, said condensate being returned to the lower pressure column, said oxygen-poor liquid being vaporized thereby, and said vapor is withdrawn as product or expanded in a turbine to provide refrigeration.

11. A method as claimed in claim 10, wherein said vapor stream is withdrawn from the same level of the lower pressure column as the argon-enriched stream.

12. In a method of separating argon and oxygen from air comprising:

(a) passing air under pressure at low temperature into a double rectification column comprising a higher pressure column, a lower pressure column and a condenser-reboiler;

(b) forming in said higher pressure column an oxygen-rich liquid fraction and an oxygen-poor vapor fraction;

(c) condensing the oxygen-poor fraction in the condenser-reboiler a portion of the condensed vapor being utilized as reflux for the higher pressure column and the remainder being withdrawn therefrom;

(d) sub-cooling said withdrawn portion of the condensed oxygen-poor fraction and utilizing at least a portion of the resulting liquid as reflux in said lower pressure column;

(e) separating the oxygen-rich liquid fraction in the lower pressure column to form a nitrogen vapor fraction and an oxygen liquid fraction;

(f) withdrawing an argon-enriched stream from an intermediate level of the lower pressure column and separating it in a further column having thereon a condenser to form an argon-rich fraction and an oxygen fraction, said condenser being refrigerated by the oxygen-rich liquid prior to introduction thereof into the lower pressure column; and (g) withdrawing nitrogen vapor and oxygen vapor from the lower pressure column and passing them through a heat exchanger countercurrently to the incoming air, the improvement wherein refrigeration is transferred from the oxygen-poor liquid formed in step (d) to the oxygen-rich liquid formed in step (b) and a portion of said oxygen-poor liquid is vaporized and withdrawn as product.

13. A method in accordance with claim 12, wherein a portion of the incoming air is further compressed, cooled in the heat exchanger, expanded in a turbine and utilized to provide refrigeration for the heat exchanger.

14. A method in accordance with claim 12, wherein a portion of the sub-cooled oxygen-poor liquid formed in step (d) is used to provide refrigeration in the condenser associated with said further column.

15. A method in accordance with claim 14, wherein said oxygen-poor liquid is mixed with a stream of liquid oxygen withdrawn from the lower pressure column in an auxiliary liquid-vapor contact column which contains said condenser, there being formed a stream of nitrogen or a mixture of nitrogen and oxygen which is withdrawn as product or expanded in a turbine to provide refrigeration.

16. A method in accordance with claim 14, wherein said oxygen-poor liquid is mixed with a stream of liquid oxygen withdrawn from the lower pressure column in an auxiliary liquid-vapor contact column which contains said condenser, there being formed a stream of nitrogen or a mixture of nitrogen and oxygen which is withdrawn as product.

17. A method in accordance with claim 12, wherein a portion of the oxygen-poor liquid is passed in heat exchange with a vapor stream withdrawn from an intermediate level of the lower pressure column, said vapor stream being at least partially condensed thereby, said condensate being returned to the lower pressure column, said oxygen-poor liquid being vaporized thereby, and said vapor is withdrawn as product or expanded in a turbine to provide refrigeration.

18. A method as claimed in claim 17, wherein said vapor stream is withdrawn from the same level of the lower pressure column as the argon-enriched stream.

* * * * *

UNITED STATES PATENT AND TRADEMARK OFFICE

CERTIFICATE OF CORRECTION

PATENT NO. : 4,783,208

DATED : Nov. 8, 1988

INVENTOR(S) : Thomas Rathbone

It is certified that error appears in the above-identified patent and that said Letters Patent is hereby corrected as shown below:

Column 7, line 31, delete ", 38".

Column 11, line 9, delete "withdrawn as product or".

Signed and Sealed this

Twenty-eighth Day of November 1989

*Attest:*

JEFFREY M. SAMUELS

*Attesting Officer* *Acting Commissioner of Patents and Trademarks*